United States Patent [19]

Küttner et al.

[11] Patent Number: 4,630,582

[45] Date of Patent: Dec. 23, 1986

[54] ARRANGEMENT FOR RAPIDLY ADJUSTING AN ELECTROMAGNETIC LOAD ASSOCIATED WITH AN INTERNAL COMBUSTION ENGINE

[75] Inventors: Thomas Küttner; Max Straubel, both of Stuttgart; Wolf Wessel, Oberriexingen, all of Fed. Rep. of Germany

[73] Assignee: Robert Bosch GmbH, Stuttgart, Fed. Rep. of Germany

[21] Appl. No.: 661,808

[22] Filed: Oct. 17, 1984

[30] Foreign Application Priority Data

Oct. 19, 1983 [DE] Fed. Rep. of Germany ..... 3337908

[51] Int. Cl.[4] ..... F02M 51/00; F02M 3/00; F02P 33/00

[52] U.S. Cl. ..... 123/339; 123/436; 123/478

[58] Field of Search ..... 123/339, 352, 436, 440, 123/478, 489, 494

[56] References Cited

U.S. PATENT DOCUMENTS

| | | | |
|---|---|---|---|
| 4,155,332 | 5/1979 | Yaegashi et al. | 123/494 X |
| 4,332,226 | 6/1982 | Nomura et al. | 123/494 |
| 4,478,186 | 10/1984 | Bauer et al. | 123/478 X |
| 4,489,690 | 12/1984 | Burkel et al. | 123/436 X |

*Primary Examiner*—Tony M. Argenbright
*Attorney, Agent, or Firm*—Walter Ottesen

[57] ABSTRACT

The invention is directed to an arrangement for rapidly adjusting an electromagnetic load associated with internal combustion engines. The output signals of two control systems are combined in a logic circuit such that priority is assigned to one of the two control systems. Dependent on the output signal of the higher-order control system, an evaluation circuit acts on a switch arrangement to thereby suitably influence the signal resulting from the combining operation of the output signals of the two control systems. This arrangement makes it possible to speed up the delivery of the output signal of the higher-order control system to the electromagnetic load which may be an injection valve, for example. The higher-order control system may be a smooth-running control system.

13 Claims, 9 Drawing Figures t t t t t t t

ARRANGEMENT FOR RAPIDLY ADJUSTING AN ELECTROMAGNETIC LOAD ASSOCIATED WITH AN INTERNAL COMBUSTION ENGINE

FIELD OF THE INVENTION

The invention relates to an arrangement for rapidly adjusting an electromagnetic load, particularly in conjunction with an internal combustion engine. Two control signals for influencing the electromagnetic load are combined in a combining circuit to form a control signal for acting upon the load.

BACKGROUND OF THE INVENTION

From German published patent application DE-OS No. 3,130,380, an idle-speed control system is known wherein an increase in the engine speed desired value with a delayed fall-off is made to follow the increase in the actual engine speed value. Also, reference may be made to U.S. patent application Ser. No. 657,212 entitled "Apparatus for Influencing Control Quantities of an Internal Combustion Engine" which was filed on Oct. 3, 1984 and is assigned to the same assignee as the present application. This other application discloses a smooth-running control system wherein each cylinder of the engine has a control unit corresponding thereto. These two control systems now are to operate jointly to act on the amount of fuel metered to the individual cylinders. The simplest way to accomplish this would be to combine the output signals of the two control systems in a combining logic operation, where required, and form a suitable signal as described in the above-identified United States patent application.

In such a combining logic operation, both control systems would have equal access to the fuel metering apparatus. However, the smooth-running control system referred to above is in a position to dampen vibrations of the vehicle only if its output signal is delivered to the fuel metering apparatus as rapidly as possible to thereby act upon the quantity of fuel to be injected also as rapidly as possible. This can only be accomplished if the two control systems are not treated equally but, rather, if the smooth-running control system has priority status.

SUMMARY OF THE INVENTION

The arrangement of the invention for rapidly adjusting an electromagnetic load affords the advantage of assigning priority to one of the two control systems when they are combined in a combining logic circuit. For this purpose, the output signals of the two control systems are combined in a logic operation with a subsequent signal being formed, where applicable; further, the output signal of the higher-order control system is checked by an evaluation circuit influencing, where applicable, the output signal of the combining logic circuit.

Further advantages and improvements of the invention will become apparent from the subsequent description in conjunction with the drawing and from the claims.

BRIEF DESCRIPTION OF THE DRAWING

The invention will now be described in more detail with reference to the drawing wherein.

DESCRIPTION OF THE PREFERRED EMBODIMENTS OF THE INVENTION

Figure 1:
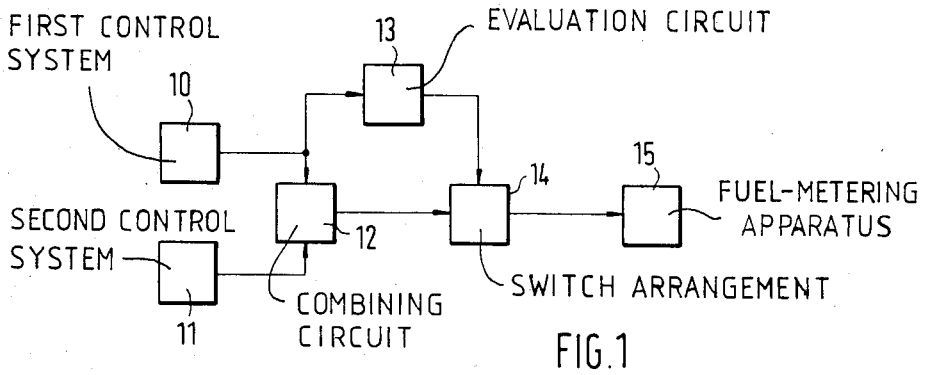
FIG. 1 is a block diagram of an arrangement of the invention for rapidly adjusting an electromagnetic load.

Referring now to the block diagram of FIG. 1, reference numerals 10 and 11 identify two control systems, with the first control system 10 being assigned priority over the second control system 11. Reference numeral 12 identifies a combining logic circuit including, where applicable, a signal processor. An evaluation circuit is identified by reference numeral 13, a switch arrangement carries reference numeral 14, and reference numeral 15 denotes a fuel metering apparatus of an internal combustion engine.

The output signals of the two control systems 10 and 11 are applied to a combining circuit 12. The output signal of the first control system 10 is further applied to evaluation circuit 13. The output signal of combining circuit 12 is supplied to switch arrangement 14 which, in addition, receives the output signal of evaluation circuit 13. The output signal of switch arrangement 14 is applied to fuel metering apparatus 15.

Normally, switch arrangement 14 directly passes the output signal of combining circuit 12 to fuel metering apparatus 15. Under normal conditions, therefore, the input signal of fuel metering apparatus 15 depends equally on control systems 10 and 11. Evaluation circuit 13 performs a continuous check on the output signal of control system 10 and influences switch arrangement 14 in dependence on the result of these checks. It is thus possible for switch arrangement 14 to modify the output signal of combining circuit 12 in dependence on the output signal of higher-order control system 10. Above all, it is thereby possible, for example, to assign the output signal of higher-order control system 10 a stronger influence on fuel metering apparatus 15 via evaluation circuit 13 and switch arrangement 14.

Figure 2:
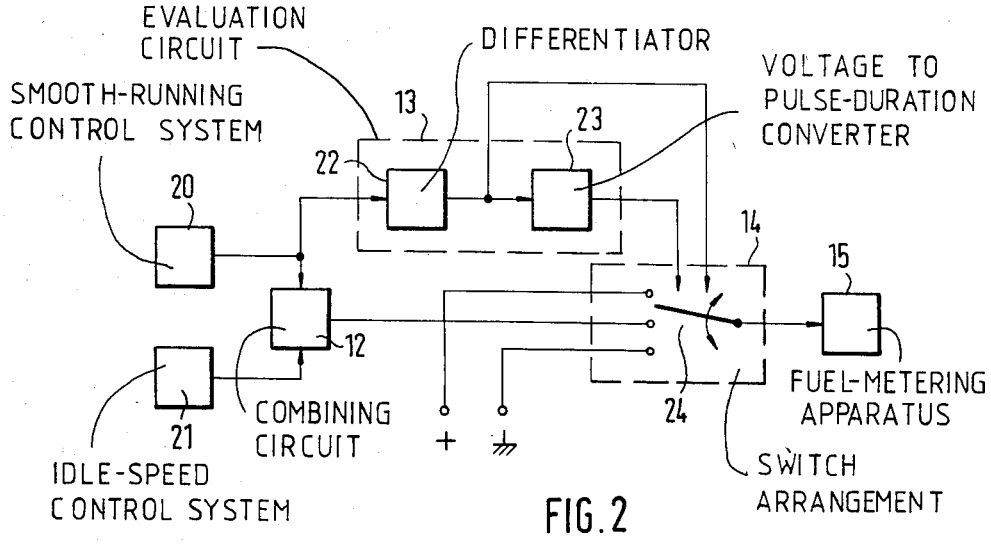
FIG. 2 is a block diagram illustrating a more detailed embodiment of the arrangement of the invention; and, FIGS. 3A–3G are a timing diagram related to the block diagram of FIG. 2.

FIG. 2 shows a more detailed embodiment of the arrangement for rapidly adjusting the electromagnetic load of FIG. 1. For this embodiment, FIG. 2 shows the following: a smooth-running control system 20; an idle-speed control system 21; combining circuit 12; evaluation circuit 13 made up of a differentiator 22 and a voltage to pulse-duration converter 23; switch arrangement 14 including a special switch 24; and, fuel metering apparatus 15 of the internal combustion engine.

The output signals of smooth-running control system 20 and of idle-speed control system 21 are applied to combining circuit 12. Further, the output signal of smooth-running control system 20 is applied to differentiator 22 of evaluation circuit 13. The output signal of differentiator 22 goes to voltage to pulse-duration converter 23, while being also applied to special switch 24 of switch arrangement 14. In addition, special switch 24 also receives the output signal of the voltage to pulse-duration converter 23. Inputs for special switch 24 are the output signal of combining circuit 12, the supply voltage of the entire arrangement, and ground. The output signal of special switch 24 of switch arrangement 14 is applied to fuel metering apparatus 15 of the internal combustion engine.

The mode of operation of the embodiment of FIG. 2 shall now be explained in greater detail with reference to the timing diagram of FIG. 3.

Figures 3A, 3B, 3C, 3D, 3E, 3F, 3G:
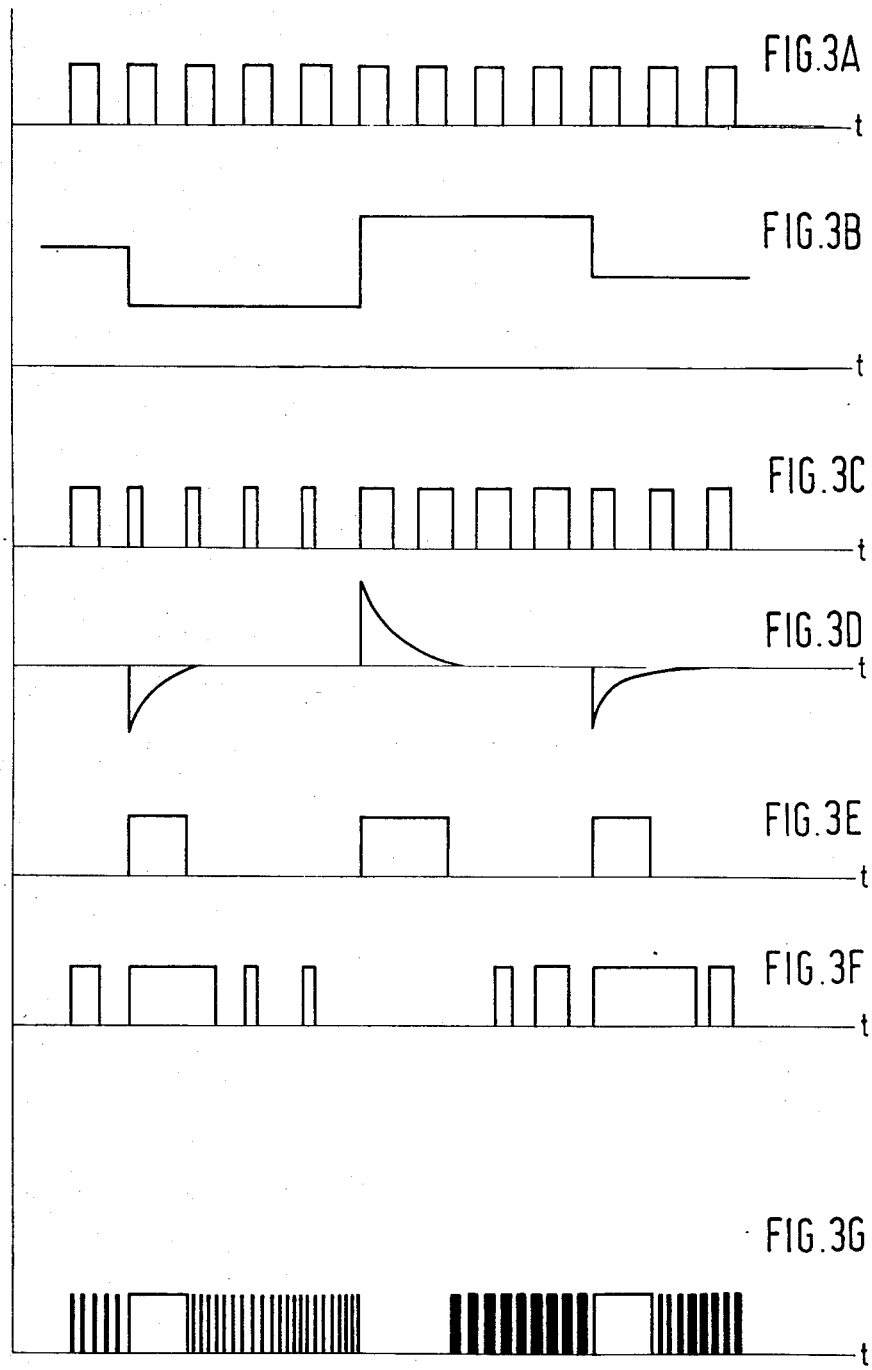

The diagram of FIG. 3A shows the output signal of idle-speed control system 21. The diagram of FIG. 3B shows the output signal of smooth-running control system 20. Combining circuit 12 combines these two signals to produce an output signal as illustrated in the diagram of FIG. 3C. In FIG. 3C it will be seen that the rectangular pulses of FIG. 3A are shortened or extended in dependence on the signal of FIG. 3B. Dependent on the output signal of smooth-running control system 20, that is, dependent on the signal of FIG. 3B, differentiator 22 generates an output signal illustrated in the diagram of FIG. 3D.

In the signal of FIG. 3D, it is important that, depending on the step direction of the signal of FIG. 3B, the signal of FIG. 3D will assume positive or negative values and that the step heights of the signal of FIG. 3D correspond to the step heights of the signal of FIG. 3B. The output signal of differentiator 22 is applied to special switch 24 and determines its switching direction. With positive values of the signal of FIG. 3D, the result may be, for example, that special switch 24 of switch arrangement 14 is connected to ground, whereas, with negative values of the signal of FIG. 3D, special switch 24 is applied to the supply voltage.

The voltage to pulse-duration converter 23 generates the signal of FIG. 3E from the signal of FIG. 3D. Thus, the voltage to pulse-duration converter 23 converts the step height of the signal of FIG. 3D into a corresponding pulse duration.

The signal of FIG. 3E acts likewise on special switch 24. In this arrangement, the signal of FIG. 3E determines the duration of operation of switch 24. This means that special switch 24 operates in the direction determined by the signal of FIG. 3D, maintaining this operating condition for a period of time determined by the signal of FIG. 3E. The diagram of FIG. 3F shows the output signal of switch arrangement 14, that is, the signal that acts upon fuel metering apparatus 15 of the internal combustion engine.

In principle, the signal of FIG. 3F corresponds to the signal of FIG. 3C; they differ in that on each step in the output signal of smooth-running control system 20, that is, on each step in the signal of FIG. 3B, the signal of FIG. 3F deviates from the signal of FIG. 3C. The magnitude as well as the duration of this deviation depend on the direction and height of the step of the signal of FIG. 3B.

For the combining logic operation of the signals of FIGS. 3A and 3B, three cases may be distinguished. If the frequency of the signal of FIG. 3A is high when compared with the frequency of the signal of FIG. 3B, the combining logic operation performed on these two signals in the embodiment described is executed so that the signal of FIG. 3C is enabled and disabled as illustrated in the timing diagram of FIG. 3G, in dependence on the signals of FIGS. 3D and 3E.

By contrast, if the frequency of the signal of FIG. 3A is only in the range of one to ten times the frequency of the signal of FIG. 3B, these two signals are combined such that the pulse duration of the individual pulses of the signal of FIG. 3E is added to, or subtracted from the pulse durations of the pulses of the signal of FIG. 3C in dependence on the signal of FIG. 3D. This case of a combining operation is illustrated in the timing diagram of FIG. 3F. It is also possible that the signal of FIG. 3A is of any frequency and variable. In this case, the combining operation is performed as described above and illustrated in the timing diagram of FIG. 3F. For this purpose, it is, however, necessary for the arrangement described in the embodiment to be able to detect the edges of the pulses of the signal of FIG. 3A.

The output signal of the described arrangement for rapid adjustment of an electromagnetic load is used, for example, for the activation of a solenoid-operated valve acting upon an internal combustion engine. This may be accomplished by final controlling elements, for example, which relate directly or indirectly to fuel metering, exhaust gas recirculation, beginning of injection, duration of injection, air-fuel ratio, ignition point, et cetera.

While the entire arrangement may be implemented by means of a circuit configuration using discrete components, a suitably programmed computer may also be utilized for this purpose. The use of a computer for the implementation of the idle-speed control system, the smooth-running control system and also for the arrangement described will be particularly advantageous.

It is understood that the foregoing description is that of the preferred embodiments of the invention and that various changes and modifications may be made thereto without departing from the spirit and scope of the invention as defined in the appended claims.

What is claimed is:

1. Arrangement for rapidly adjusting an electromagnetic load associated with an internal combustion engine or the like, the arrangement comprising:

first control means for generating a first signal for influencing said load;

second control means for generating a second signal for influencing said load;

combining circuit means for combining said first and said second signals to form one control signal for controlling said load;

said first control means having a priority status over said second control means;

evaluation means receiving and evaluating said first signal for generating an output influencing signal dependent thereon; and, selection means for receiving both said control signal and said output influencing signal so as to permit said output influencing signal to influence said control signal applied to said load in dependence upon the evaluation performed in said evaluation means.

2. The arrangement of claim 1, said evaluation means being configured to determine how said control signal is to be influenced.

3. The arrangement of claim 1, said selection means including switch means movable for a selection between three positions, two of said positions corresponding to two predetermined values, respectively, and the remaining one of said positions corresponding to said control signal uninfluenced by said influencing signal.

4. The arrangement of claim 2, said evaluation means comprising: differentiating means for receiving said first signal; and, a voltage to pulse-duration converter connected to the output of said differentiating means.

5. The arrangement of claim 3, said electromagnetic load having a member movable between two end positions, said predetermined values being selected so as to cause said member to be displaced in the direction of said end positions, respectively, as rapidly as possible.

6. The arrangement of claim 5, said two predetermined values being the supply voltage and ground, respectively.

7. The arrangement of claim 1, said first signal having a clock frequency; said evaluation means and said selection means including means for influencing said control signal in dependence upon said clock frequency.

8. The arrangement of claim 7, said last-mentioned means being configured for switching said control signal in and out in dependence upon said first signal when said clock frequency thereof drops beneath a definite predetermined value.

9. The arrangement of claim 7, said last-mentioned means being configured to add or subtract pulse durations to said control signal when said clock frequency of said first control signal exceeds a definite predetermined value, said pulse durations being dependent upon said first signal.

10. The arrangement of claim 9, said definite predetermined value being one-tenth of said clock frequency of said first signal.

11. The arrangement of claim 1, said first control means being a smooth-running control system of the internal combustion engine.

12. The arrangement of claim 11, said second control means being an idle-speed control system.

13. The arrangement of claim 1, said electromagnetic load being a direct-current positioning device such as a magnetic valve for metering fuel to the engine.

* * * * *